US008257784B2

(12) United States Patent
Grayson et al.

(10) Patent No.: US 8,257,784 B2
(45) Date of Patent: Sep. 4, 2012

(54) METHODS FOR IDENTIFYING ARTICLES OF MANUFACTURE

(75) Inventors: Benjamin Alan Grayson, Ann Arbor, MI (US); Debasish Benerjee, Ann Arbor, MI (US); Minjuan Zhang, Ann Arbor, MI (US); Yasuo Uehara, Ann Arbor, MI (US); Masahiko Ishii, Okazaki (JP)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 10 days.

(21) Appl. No.: 12/853,801

(22) Filed: Aug. 10, 2010

(65) Prior Publication Data

US 2012/0040091 A1 Feb. 16, 2012

(51) Int. Cl.
*B05D 5/06* (2006.01)

(52) U.S. Cl. ..... 427/162; 427/7; 427/8; 427/10

(58) Field of Classification Search ..... 427/7–10
See application file for complete search history.

(56) References Cited

U.S. PATENT DOCUMENTS

| | | | |
|---|---|---|---|
| 3,247,392 | A | 4/1966 | Thelen |
| 3,769,515 | A | 10/1973 | Clark, Jr. |
| 3,885,408 | A | 5/1975 | Clark, Jr. |
| 3,910,681 | A | 10/1975 | Elliott et al. |
| 4,079,605 | A | 3/1978 | Bartels |
| 4,449,126 | A | 5/1984 | Pekker |
| 4,525,023 | A | 6/1985 | Lawson |
| 4,643,518 | A | 2/1987 | Taniguchi |
| 4,673,914 | A | 6/1987 | Lee |
| 4,714,308 | A | 12/1987 | Sawamura et al. |
| 4,868,559 | A | 9/1989 | Pinnow |
| 5,007,710 | A | 4/1991 | Nakajima et al. |
| 5,043,593 | A | 8/1991 | Tsutsumi et al. |
| 5,132,661 | A | 7/1992 | Pinnow |
| 5,138,468 | A | 8/1992 | Barbanell |
| 5,245,329 | A | 9/1993 | Gokcebay |
| 5,279,657 | A | 1/1994 | Phillips et al. |
| 5,283,431 | A | 2/1994 | Rhine |
| 5,323,416 | A | 6/1994 | Bhat et al. |
| 5,491,470 | A | 2/1996 | Veligdan |
| 5,543,665 | A | 8/1996 | Demarco |

(Continued)

FOREIGN PATENT DOCUMENTS

| | | |
|---|---|---|
| WO | WO02054030 | 7/2002 |

(Continued)

OTHER PUBLICATIONS

Laser 2000 Gmbttp://www.laser2000.de/fileadmin/Produkdaten/SK_WEB/Datenblaetter_SEM/SEMROCK-StopLine-Notchfilter.pdf, accessed Feb. 2, 2010.

(Continued)

*Primary Examiner* — Timothy Meeks
*Assistant Examiner* — Elizabeth Burkhart
(74) *Attorney, Agent, or Firm* — Dinsmore & Shohl, LLP

(57) ABSTRACT

In one embodiment, a method for identifying an article of manufacture may include: producing a plurality of multilayer photonic structures, wherein each of the plurality of multilayer photonic structures has a unique intensity profile; incorporating one of the plurality of multilayer photonic structures that produces the unique intensity profile into a coating; and generating an electronic code corresponding to the unique intensity profile of one of the plurality of multilayer photonic structures.

20 Claims, 7 Drawing Sheets

U.S. PATENT DOCUMENTS

| | | | | |
|---|---|---|---|---|
| 5,653,792 | A | 8/1997 | Phillips et al. | |
| 5,691,844 | A | 11/1997 | Oguchi et al. | |
| 5,850,309 | A | 12/1998 | Shirai et al. | |
| 6,049,419 | A | 4/2000 | Wheatley et al. | |
| 6,055,079 | A | 4/2000 | Hagans et al. | |
| 6,130,780 | A | 10/2000 | Joannopoulos et al. | |
| 6,156,115 | A | 12/2000 | Pfaff et al. | |
| 6,180,025 | B1 | 1/2001 | Schoenfeld et al. | |
| 6,399,228 | B1 | 6/2002 | Simpson | |
| 6,433,931 | B1 | 8/2002 | Fink et al. | |
| 6,565,048 | B1 | 5/2003 | Meyer et al. | |
| 6,574,383 | B1 | 6/2003 | Erchak et al. | |
| 6,618,149 | B1 | 9/2003 | Stirton | |
| 6,624,945 | B2 | 9/2003 | Fan et al. | |
| 6,667,095 | B2 | 12/2003 | Wheatley et al. | |
| 6,873,393 | B2 | 3/2005 | Ma | |
| 6,887,526 | B1 | 5/2005 | Arit et al. | |
| 6,903,873 | B1 | 6/2005 | Joannopoulos et al. | |
| 6,927,900 | B2 | 8/2005 | Liu et al. | |
| 6,997,981 | B1 | 2/2006 | Coombs et al. | |
| 7,098,257 | B2 | 8/2006 | Rink et al. | |
| 7,123,416 | B1 | 10/2006 | Erdogan et al. | |
| 7,141,297 | B2 | 11/2006 | Condo et al. | |
| 7,184,133 | B2 | 2/2007 | Coombs et al. | |
| 7,190,524 | B2 | 3/2007 | Grawert et al. | |
| 7,215,473 | B2 | 5/2007 | Flemin | |
| 7,267,386 | B2 | 9/2007 | Hesch | |
| 7,367,690 | B2 | 5/2008 | Chen | |
| 7,410,685 | B2 | 8/2008 | Rosenberger et al. | |
| 7,446,142 | B2 | 11/2008 | Meisenburg et al. | |
| 7,483,212 | B2 | 1/2009 | Cho et al. | |
| 2001/0022151 | A1 | 9/2001 | Sliwinski et al. | |
| 2002/0129739 | A1 | 9/2002 | Yanagimoto et al. | |
| 2003/0059549 | A1 | 3/2003 | Morrow et al. | |
| 2004/0047055 | A1 | 3/2004 | Mizrahi et al. | |
| 2004/0156984 | A1 | 8/2004 | Vitt et al. | |
| 2004/0179267 | A1* | 9/2004 | Moon et al. | 359/566 |
| 2004/0246477 | A1 | 12/2004 | Moon et al. | |
| 2004/0263983 | A1 | 12/2004 | Acre | |
| 2005/0126441 | A1 | 6/2005 | Skelhorn | |
| 2006/0030656 | A1 | 2/2006 | Tarng et al. | |
| 2006/0081858 | A1 | 4/2006 | Lin et al. | |
| 2006/0159922 | A1 | 7/2006 | O'Keefe | |
| 2006/0222592 | A1 | 10/2006 | Burda | |
| 2007/0221097 | A1 | 9/2007 | Tarng et al. | |
| 2009/0046368 | A1 | 2/2009 | Banerjee et al. | |
| 2009/0082659 | A1 | 3/2009 | Ham et al. | |
| 2009/0153953 | A1* | 6/2009 | Banerjee et al. | 359/359 |
| 2009/0303044 | A1 | 12/2009 | Furuichi et al. | |
| 2010/0208338 | A1 | 8/2010 | Banerjee et al. | |
| 2010/0209593 | A1 | 8/2010 | Banerjee et al. | |

FOREIGN PATENT DOCUMENTS

| | | |
|---|---|---|
| WO | WO03062871 | 3/2003 |

OTHER PUBLICATIONS

International Search Report for PCT/US2010/022378 mailed Mar. 30, 2010.

Hongqiang et al., "Disordered dielectric high reflectors with broadband from visible to infrared," Applied Physics Letters, American Institute of Physics, Melville, NY, US. vol. 74, No. 22, dated May 31, 2009.

Xifre-Perez et al, "Porous silicon mirrors with enlarged omnidirectional band gap," Journal of Applied Physics, American Institute of Physics, Melville, NY, US, vol. 97, No. 6, dated Mar. 9, 2005.

Bendiganavale A.K., Malshe, V.C., "Infrared Reflective Inorganic Pigments", Recent Patents on Chemical Engineering, 2008, 1, 67-79.

D.P. Young, Jr., et al. "Comparison of Avian Responses to UV-Light Reflective Paint on Wind Turbines," National Renewable Energy Laboratory, Subcontract Report, Jan. 2003.

Maier, E.J. "To Deal With the Invisible": On the biological significance of ultraviolet sensitivity in birds. Naturwissenschaften 80: 476-478, 1993.

Nison, J., "Twinkle, Twinkle Little Star," Asia Pacific Coating Journal, Feb. 2004.

Fink, Joel "A Dielectric Omnidirectional Reflector", E.L. Thomas, Science, vol. 282, Nov. 27, 1988.

Lin, Weihua, "Design and Fabrication of Omnidirectional Reflectors in the Visible Range" Journal of Modern Optics, vol. 52, No. 8, 1155 (2005).

Chen, Kevin M. "Si02/Ti02 Omnidirectional Reflector and Microcavity Resonator Via the Sol-Gel Method", Appl. Phys. Lett., vol. 75, No. 24, Dec. 13, 1999.

Almeida, R.M., "Photonic Bandgap Materials and Structures by Sol-Gel Processing", Journal of Non-Crystalline Solids, 405-499 (2003).

Deopura, M., "Dielectric Omnidirectional Visible Reflector," Optics Letters, Aug. 1, 2001, vol. 16, No. 15.

Decorby, R.G., "Planar Omnidirectional Reflectors in Chalcogenide Glass and Polymer" Optics Express, 6228, Aug. 8, 2005.

Clement, T.J., "Improved Omnidirectional Reflectors in Chalcogenide Glass and Polymer by Using the Silver Doping Technique", Optics Express, 14, 1789 (2006).

Bryant, A., "All-Silicon Omnidirectional Mirrors Based on One-Dimensional Crystals", Appl. Phys. Lett. vol. 82, No. 19, May 12, 2003.

Chigrin, D.N., "Observation of Total Omnidirectional Reflection From a One-Dimensional Dielectric Lattice", Appl. Phys. A. 68, 25-28 (1999).

Park, Y., "GaAs-based Near-infrared Omnidirectional Reflector," Appl. Phys. Lett., vol. 82, No. 17, Apr. 28, 2003.

H-Y Lee, "Design and Evaluation of Omnidirectional One-Dimensional Photonic Crystals", Journal of Appl. Phys. vol. 93, No. 2, Jan. 15, 2003.

Banerjee, Debasish, "Narrow-band Omnidirectional Structural Color", SAE World Congress 01-1049 (2008).

U.S. Appl. No. 12/686,861, filed Jan. 13, 2010 entitled "Multilayer Photonic Structures".

U.S. Appl. No. 12/853,801, filed Aug. 10, 2010 entitled "Methods for Identifying Articles of Manufacture".

Laser 2000 GmbH, http://www.laser2000.de/fileadmin/Produktdaten/SK_WEB/Datenblaetter_SEM/SEMROCK-StopLine-Notchfilter.pdf, accessed Feb. 2, 2010.

Office Action mailed Sep. 22, 2011 as it relates to U.S. Appl. No. 12/853,718.

* cited by examiner

METHODS FOR IDENTIFYING ARTICLES OF MANUFACTURE

TECHNICAL FIELD

The present specification generally relates to methods for identifying an article of manufacture and, more specifically, to methods for identifying an article of manufacture with a multilayer photonic structure.

BACKGROUND

Articles of manufacture such as vehicles and the like are commonly marked during the manufacturing process with identifying indicia such as serial numbers and vehicle identification numbers (VIN). The identifying indicia may provide information about the article of manufacture such as the date of manufacture and the like and assist with tracking the articles of manufacture throughout their useful life. For example, the identifying indicia are useful for tracking inventory, recovering stolen items, identifying the location of manufacture, etc. However, such identification is integral with the article of manufacture, and thus, require the article of manufacture to be accessible to utilize the identifying indicia.

Accordingly, a need exists for alternative methods for identifying an article of manufacture.

SUMMARY

In one embodiment, a method for identifying an article of manufacture may include: producing a plurality of multilayer photonic structures, wherein each of the plurality of multilayer photonic structures has a unique intensity profile; incorporating one of the plurality of multilayer photonic structures that produces the unique intensity profile into a coating; and generating an electronic code corresponding to the unique intensity profile of one of the plurality of multilayer photonic structures.

In another embodiment, a method for identifying an article of manufacture may include: providing a coating including a multilayer photonic structure that produces a unique intensity profile; applying the coating to at least a portion of an article of manufacture; and correlating an identifying indicia of the article of manufacture to the unique intensity profile.

In yet another embodiment, a method for identifying an article of manufacture may include: collecting a sample from an article of manufacture, wherein the sample includes a multilayer photonic structure having a unique intensity profile; transmitting a reference light to the multilayer photonic structure to produce the unique intensity profile; detecting the unique intensity profile; querying an electronic database to determine identifying indicia of the article of manufacture; retrieving the identifying indicia of the article of manufacture from the electronic database to identify the article of manufacture.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
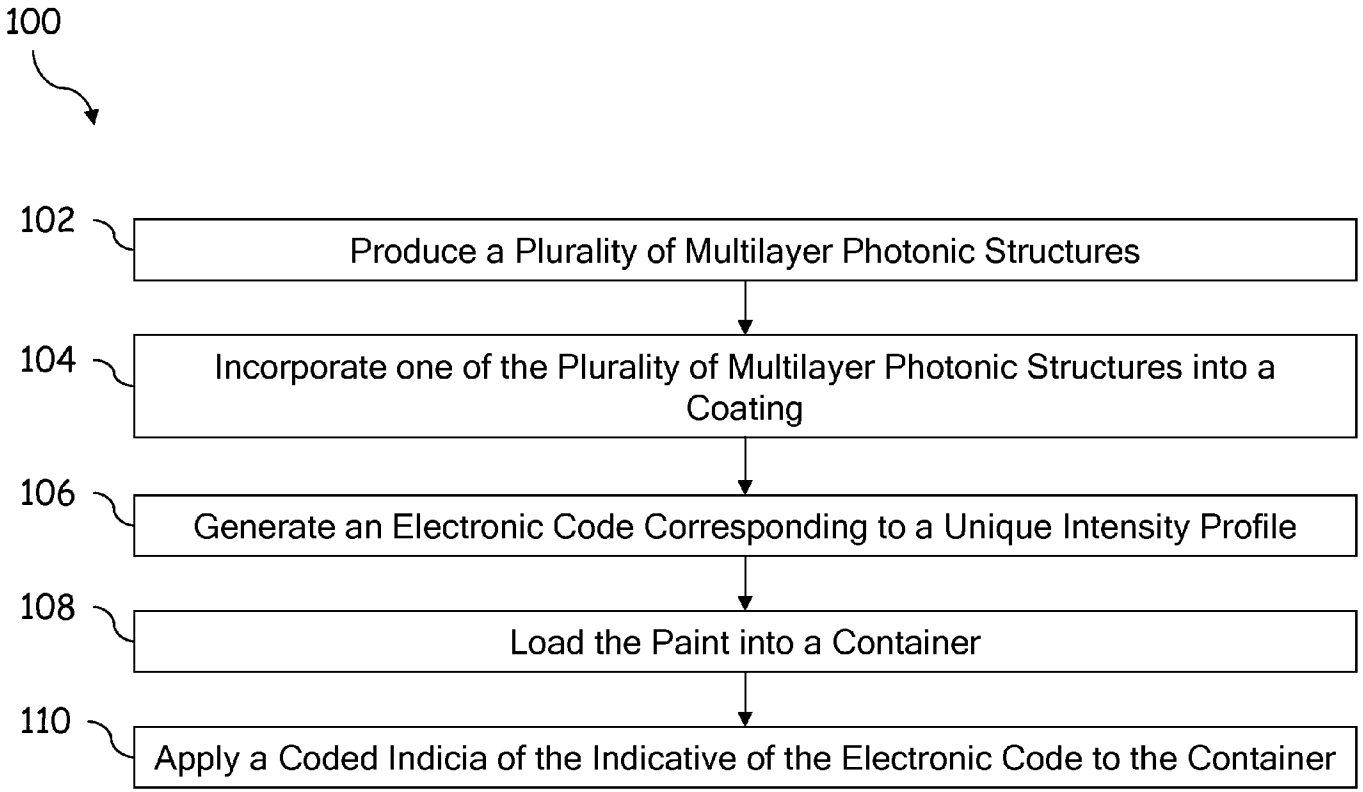
FIG. 1 is a flow diagram of a method for identifying an article of manufacture according to one or more embodiments shown and described herein.

FIG. 1 is a flow diagram of one embodiment of a method for identifying an article of manufacture. The method may include producing a plurality of multilayer photonic structures. Each of the plurality of multilayer photonic structures may be tuned to produce a unique intensity profile. The unique intensity profile may be a reflectance profile, a transmittance profile, or a combination thereof. A multilayer photonic structure that produces the unique intensity profile may be incorporated into a coating. An electronic code corresponding to the unique intensity profile may be generated. Methods for identifying articles of manufacture will be described in more detail herein.

In describing the methods for identifying an article of manufacture, reference will be made to light incident on the multilayer photonic structure. It should be understood that the term "light" refers to various wavelengths of the electromagnetic spectrum, particularly wavelengths in the ultraviolet (UV), infrared (IR), and visible portions of the electromagnetic spectrum. Furthermore, as used herein, the term "unique" means limited in occurrence to a given class, situation, feature or model.

Figure 2:
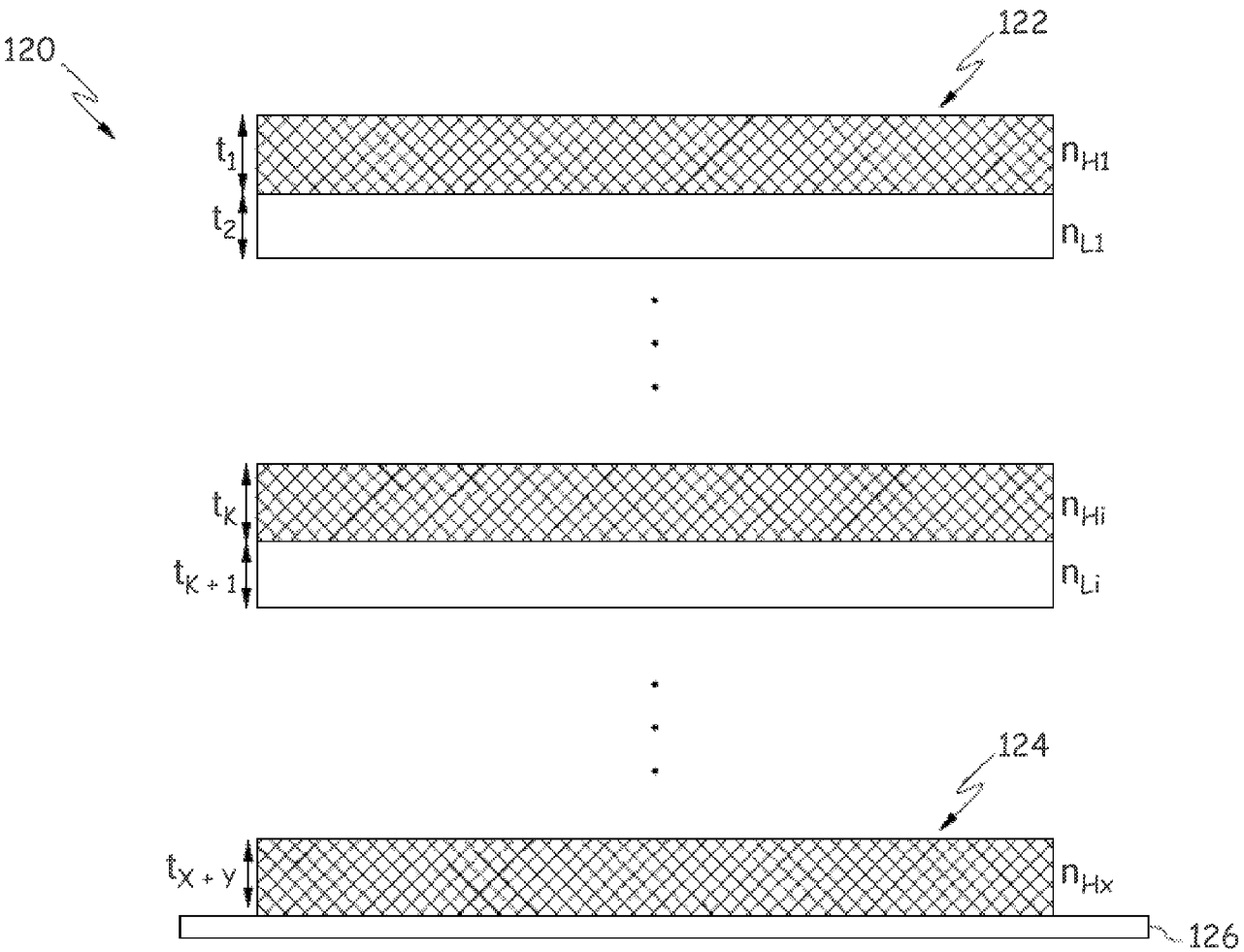
FIG. 2 schematically depicts a multilayer photonic structure according to one or more embodiments shown and described herein.

Referring now to FIG. 2, one embodiment of the multilayer photonic structure 120 is schematically depicted. As will be described in more detail herein, the multilayer photonic structures described herein generally comprise layers of material with a relatively high refractive index (e.g., high index material $n_H$) and layers of material with a relatively low refractive index (e.g., low index material $n_L$) alternately arranged. Specifically, the high index material $n_H$ has a relatively high refractive index compared to the low index material $n_L$, and the low index material $n_L$ has a relatively low refractive index compared to the high index material $n_H$.

As shown in FIG. 2, the high index material $n_H$ is generally indicated by an $n_H$ followed by a subscript indicative of a high index layer number (e.g., $n_{H1}$). Similarly, low index material $n_L$ is generally indicated by an $n_L$ followed by a subscript indicative of a low index layer number (e.g., $n_{L1}$). The first layer 122 of the multilayer photonic structure 120 is the layer furthest away from the substrate 126 and comprises a high index material $n_{H1}$. The last layer 124 of the multilayer photonic structure 120 is the layer nearest to the substrate 126 and comprises a high index material $n_{Hx}$. The ellipses indicate that the intermediate layers $n_{Hi}$, $n_{Li}$ may be repeated to achieve any total number of layers x+y, where x is the total number of layers with high index material $n_H$ and y is the total number of layers with low index material $n_L$. As depicted, embodiments of the multilayer photonic structure 120 comprise one more layer of high index material $n_H$ than low index material $n_L$, i.e., x=y+1. Thus, the total number of layers may be any odd number that can be produced by a layer synthesis process such as, for example, from about 9 to about 39, from about 5 to about 99, or from about 3 to an odd number in the hundreds. In one embodiment described herein, the thickness of each layer may be varied to yield a multilayer photonic structure 120 with a unique intensity profile. Accordingly, it should be understood that each layer of the structure may have a thickness which is independent of the thickness of any other layer in the structure. As depicted in FIG. 2, the thickness of each layer is generally indicated by $t_j$ where subscript j is indicative of a layer with a distinct thickness. The subscript j ranges from 1 to x+y, and $t_k$ and $t_{k+1}$ are the thicknesses of intermediate layers. The layers of the multilayer photonic structure 120 are deposited on a substrate 126, which may include glass, polymeric materials, ceramic materials, metallic materials, composite materials and/or various combinations thereof. For example, the layers of the multilayer photonic structure 120 may be deposited on a substrate 126 of glass that has a refractive index of about 1.52.

Figure 3:
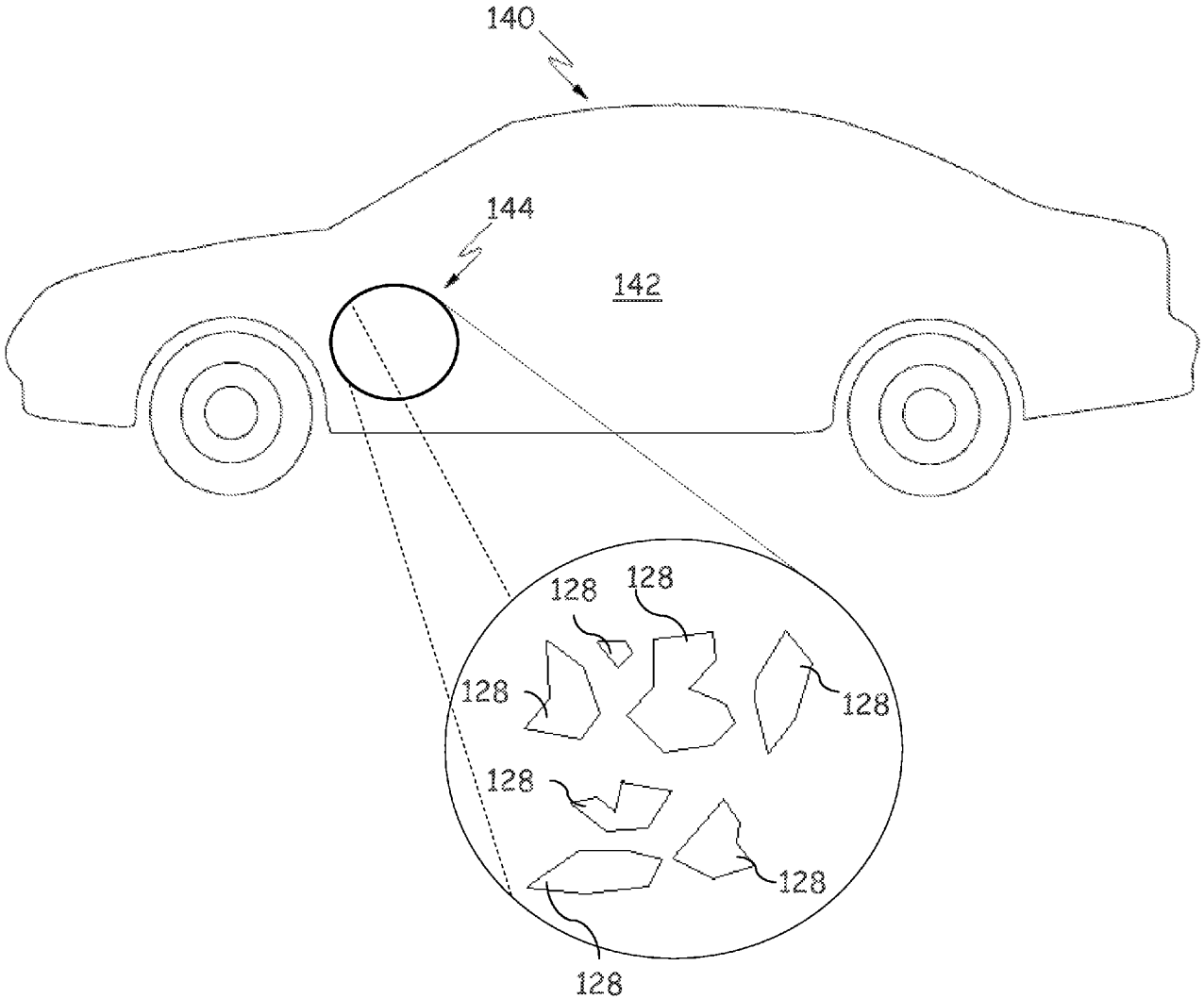
FIG. 3 schematically depicts a vehicle with a coating comprising a multilayer photonic structure according to one or more embodiments shown and described herein.

Referring now to FIGS. 2 and 3, a multilayer photonic structure 120 that produces a unique intensity profile may be incorporated into paint or similar coating which is subsequently applied to an article of manufacture, such as a vehicle 140. For example, the multilayer photonic structure 120 may be formed or rendered into flakes 128 or discrete particles and incorporated into a liquid carrier, such as an organic or inorganic binder, and utilized in a coating 142 such as paint or similar coating system which may be applied to an article of manufacture thereby imparting the optical properties of the multilayer photonic structure 120 to the article of manufacture. For example, the multilayer photonic structures 120 described herein may first be deposited onto a substrate 126. Thereafter, the multilayer photonic structure 120 is broken up into discrete particles or flakes 128. In one embodiment, the deposited multilayer photonic structure 120 may first be separated from the substrate 126 before being broken up into discrete particles. For example, the substrate 126 may be pealed from the multilayer photonic structure 120, such as when the substrate 126 is a flexible, polymeric substrate, flexible alloy, or the like. Alternatively, the substrate 126 may be dissolved in a suitable solution thereby leaving behind the multilayer photonic structure 120. The multilayer photonic structure 120 may also be pealed from the substrate 126. In another embodiment, the multilayer photonic structure 120 and substrate 126 are both broken up into discrete particles without separating the multilayer photonic structure 120 from the substrate 126.

The multilayer photonic structure 120 may be reduced to flakes 128 or discrete particles using various known techniques. For example, the multilayer photonic structure 120 may be milled or tumbled with milling media to crush the multilayer photonic structure 120 and reduce the particle size of any resulting flakes 128. In one embodiment, a pigment is mixed with the multilayer photonic structure 120 as the multilayer photonic structure 120 is reduced to discrete particles. The flakes 128 or discrete particles of the multilayer photonic structure 120 may have an average thickness from about 0.5 microns to about 10 microns and an average diameter from about 10 microns to about 50 microns. The average thickness, as used herein, means the average value taken from at least three different thickness measurements and the term average diameter is defined as the average value taken from at least three different diameter measurements.

After the multilayer photonic structure 120 has been reduced to flakes 128, the multilayer photonic structure 120 may be incorporated into a coating 142 such as paint or a coating system. For example, the multilayer photonic structure 120 (with or without a pigment) may be dispersed in a polymer matrix such that the discrete particles of the multilayer photonic structure 120 are randomly oriented in the matrix. Thereafter, the coating 142 such as a paint or a coating comprising the discrete particles of the multilayer photonic structure 120 may be deposited on an article of manufacture by spraying, electrostatic charging, powder coating, and the like.

Referring now to FIG. 1, a flow diagram 100 of preliminary steps for identifying an article of manufacture is illustrated. While the steps listed in the flow diagram 100 are set out and described in a specific sequence, it should be understood that the order in which the preliminary steps are performed may be varied.

Referring again to FIG. 2, embodiments of the multilayer photonic structure 120 may be tuned to produce an intensity profile, i.e. the multilayer photonic structure 120 may produce a desired intensity profile that has at least one distinguishing characteristic. Specifically, the multilayer photonic structure 120 may be tuned by adjusting the thickness $t_1$, $t_2, \ldots, t_k, t_{k+1}, \ldots, t_{x+y}$ of each of the layers. The thickness may be any value such as, for example, from about 0.05 nm to about 500 nm. For example, in one embodiment, the multilayer photonic structures 120 are tuned to a unique intensity profile utilizing the methods described in U.S. patent application Ser. No. 12/389,256, titled "Methods For Producing Omni-Directional Multi-Layer Photonic Structures," filed on Feb. 19, 2009, which is incorporated by reference herein.

In one embodiment, a transfer matrix method may be employed to solve a system of equations that model the intensity profile of a multilayer photonic structure 120. In one embodiment, the intensity profile is dependent on: the angle of light incident on the structure (e.g., the angle of incidence), the degree of light polarization, the wavelength(s) of interest, the thicknesses $t_j$ of each layer of the multilayer photonic structure 120 and the indices of refraction of the high and low index materials, the transmission medium, and the incidence medium. The transfer matrix method may be implemented with a computer comprising software programmed to receive various inputs from a user related to the properties of a particular multilayer photonic structure 120 and determine an intensity profile. Such software may be referred to as a photonics calculator.

The thickness $t_1, t_2, t_k, t_{k+1}, t_{x+y}$, of each of the layers may be determined by comparing an intensity profile calculated by the photonics calculator with a desired intensity profile. Specifically, an optimization or curve fitting process may operate in conjunction with the photonics calculator. In one embodiment, the sum of the squared difference between the intensity profile calculated by the photonics calculator and desired intensity profile is minimized. The least squares fitting may be performed by an optimizer implemented with computer software executed on a computer system. While particular methods of modeling and optimizing a multilayer photonic structure 120 are described herein, it should be understood that the embodiments described herein may be modeled and optimized by any method capable of tuning a multilayer photonic structure 120 to produce a desired intensity profile.

The multilayer photonic structure 120 may also be tuned by selecting the appropriate high index material $n_H$ and low index material $n_L$. In one embodiment, the values for $n_L$ and $n_H$ are selected such that the values are the same as commonly available materials. For example, the value of $n_L$ may be selected to be 1.46 while the value for $n_H$ may be selected to be 2.29 such that the values of $n_L$ and $n_H$ approximate the indices of refraction for silica ($SiO_2$, index of refraction 1.46) and titania ($TiO_2$, index of refraction 2.36), respectively. Accordingly, a multi-layer photonic structure design which utilizes 1.46 and 2.29 for $n_L$ and $n_H$, respectively, may be constructed from silica and titania or other materials having the same or similar indices of refraction. It should be understood that other values for $n_L$ and $n_H$ may be selected which correspond to the indices of refraction of other materials. Table 1, shown below, contains a non-exclusive list of possible materials and their corresponding indices of refraction which may be utilized in the multi-layer photonic structures described herein.

TABLE 1

| Material | Index of Refraction (visible spectrum) | Material | Index of Refraction (visible spectrum) |
|---|---|---|---|
| Germanium (Ge) | 4.0-5.0 | Chromium (Cr) | 3.0 |
| Tellurium (Te) | 4.6 | Tin Sulfide (SnS) | 2.6 |
| Gallium Antimonite (GaSb) | 4.5-5.0 | Low Porous Si | 2.56 |
| Indium Arsenide (InAs) | 4.0 | Chalcogenide glass | 2.6 |
| Silicon (Si) | 3.7 | Cerium Oxide ($CeO_2$) | 2.53 |
| Indium Phosphate (InP) | 3.5 | Tungsten (W) | 2.5 |
| Gallium Arsenate (GaAs) | 3.53 | Gallium Nitride (GaN) | 2.5 |
| Gallium Phosphate (GaP) | 3.31 | Manganese (Mn) | 2.5 |
| Vanadium (V) | 3 | Niobium Oxie ($Nb_2O_3$) | 2.4 |
| Arsenic Selenide ($As_2Se_3$) | 2.8 | Zinc Telluride (ZnTe) | 3.0 |
| $CuAlSe_2$ | 2.75 | Chalcogenide glass + Ag | 3.0 |
| Zinc Selenide (ZnSe) | 2.5-2.6 | Zinc Sulfate (ZnSe) | 2.5-3.0 |
| Titanium Dioxide ($TiO_2$) - solgel | 2.36 | Titanium Dioxide ($TiO_2$) - vacuum deposited | 2.43 |
| Alumina Oxide (Al2O3) | 1.75 | Sodium Aluminum Fluoride (Na3AlF6) | 1.6 |
| Yttrium Oxide (Y2O3) | 1.75 | Polyether Sulfone (PES) | 1.55 |
| Polystyrene | 1.6 | High Porous Si | 1.5 |
| Magnesium Fluoride (MgF2) | 1.37 | Indium Tin Oxide nanorods (ITO) | 1.46 |
| Lead Fluoride (PbF2) | 1.6 | Lithium Fluoride (LiF4) | 1.45 |
| Potassium Fluoride (KF) | 1.5 | Calcium Fluoride | 1.43 |
| Polyethylene (PE) | 1.5 | Strontium Fluoride (SrF2) | 1.43 |
| Barium Fluoride (BaF2) | 1.5 | Lithium Fluoride (LiF) | 1.39 |
| Silica (SiO2) | 1.5 | PKFE | 1.6 |
| PMMA | 1.5 | Sodium Fluoride (NaF) | 1.3 |
| Aluminum Arsenate (AlAs) | 1.56 | Nano-porous Silica (SiO2) | 1.23 |
| Solgel Silica (SiO2) | 1.47 | Sputtered Silica (SiO2) | 1.47 |
| N,N' bis(1naphthyl)-4,4'Diamine (NPB) | 1.7 | Vacuum Deposited Silica (SiO2) | 1.46 |
| Polyamide-imide (PEI) | 1.6 | Hafnium Oxide | 1.9-2.0 |
| Fluorcarbon (FEP) | 1.34 | Polytetrafluro-Ethylene (TFE) | 1.35 |
| Chlorotrifuoro-Ethylene (CTFE) | 1.42 | Cellulose Propionate | 1.46 |
| Cellulose Acetate Butyrate | 1.46-1.49 | Cellulose Acetate | 1.46-1.50 |
| Methylpentene Polymer | 1.485 | Ethyl Cellulose | 1.47 |

TABLE 1-continued

| Material | Index of Refraction (visible spectrum) | Material | Index of Refraction (visible spectrum) |
|---|---|---|---|
| Acetal Homopolymer | 1.48 | Acrylics | 1.49 |
| Cellulose Nitrate | 1.49-1.51 | Polypropylene (Unmodified) | 1.49 |
| Polyallomer | 1.492 | Polybutylene | 1.50 |
| Ionomers | 1.51 | Polyethylene (Low Density) | 1.51 |
| Nylons (PA) Type II | 1.52 | Acrylics Multipolymer | 1.52 |
| Polyethylene (Medium Density) | 1.52 | Styrene Butadiene Thermoplastic | 1.52-1.55 |
| PVC (Rigid) | 1.52-1.55 | Nylons (Polyamide) Type 6/6 | 1.53 |
| Urea Formaldehyde | 1.54-1.58 | Polyethylene (High Density) | 1.54 |
| Styrene Acrylonitrile Copolymer | 1.56-1.57 | Polystyrene (Heat & Chemical) | 1.57-1.60 |
| Polycarbornate (Unfilled) | 1.586 | Polystyrene (General Purpose) | 1.59 |
| Polysulfone | 1.633 | | |

For example, the multilayer photonic structure 120 may be tuned by selecting a high index material $n_H$, a low index material $n_L$, and a desired intensity profile. In one embodiment, an initial solution of the thickness $t_1$, $t_2, \ldots, t_k, t_{k+1}, \ldots, t_{x+y}$ of each of the layers is set to a quarter wavelength of the of the wavelength of a peak (or maxima) of the desired intensity profile. Beginning with the initial solution, the optimizer iteratively compares the output intensity profile from the photonics calculator to the desired intensity profile. Based on such a comparison, the optimizer supplies a subsequent solution that is used by the photonics calculator to produce a subsequent output intensity profile. The solving and comparison steps are repeated until the output intensity profile converges upon the desired intensity profile. Another embodiment may utilize a random number generator to generate the initial solution. A further embodiment may provide a different initial solution for different subsets of the layer. For example, an intensity profile may comprise three maxima at three different wavelengths. The multilayer photonic structure 30 may then be divided into three sections such that the layers of each section have an initial solution thickness based on the quarter wavelength of one of the maxima, i.e. the layers of section one start with an initial solution thickness corresponding to one maxima, the layers of section two start with an initial solution thickness corresponding to another maxima, and the layers of section three start with an initial solution thickness corresponding to a further maxima.

The unique intensity profile may be a reflectance profile, a transmittance profile or a combination thereof. Reflectance, as used herein, refers to the fraction or percentage of light incident on the multilayer photonic structure 120 which is reflected by the multilayer photonic structure 120 and may be plotted as a function of the wavelength of light incident on the structure. Transmittance, as used herein, refers to the fraction or percentage of light incident on the multilayer photonic structure 120 which is transmitted or passed through the multilayer photonic structure 120 and may be plotted as a function of the wavelength of light incident on the structure.

While specific embodiments of the methods for identifying an article of manufacture described herein utilize a tuned reflectance and/or transmittance to produce a unique intensity profile, it should be understood that the methods described herein may, in the alternative, utilize absorptance for producing an intensity profile. Absorptance, as used herein, refers to the fraction or percentage of light incident on the multilayer photonic structure 120 which is neither reflected nor transmitted and may be determined from the reflectance and the transmittance. Therefore, embodiments of the unique intensity profile may comprise a reflectance, a transmittance, an absorptance, or any combination thereof.

Referring again to FIG. 1, a method for identifying an article of manufacture may include the step 102 of producing a plurality of multilayer photonic structures 120 (FIG. 2) each having a unique intensity profile and the step 104 of incorporating one of the plurality of multilayer photonic structures 120 that produces the unique intensity profile into a coating, as described hereinabove. It is noted that, while specific embodiments describe incorporating multilayer photonic structures 120 into paint or coatings, embodiments of the present disclosure may also comprise multilayer photonic structures 120 incorporated into a sheet or wrap, such as, for example, a single layered material or vinyl that is applied to the surface of an article of manufacture.

In one embodiment, the method for identifying an article of manufacture may include a step 106 of generating an electronic code corresponding to a unique intensity profile. The electronic code is analog or digital data indicative of an intensity profile that is capable of being stored on an electronic memory such as, for example, RAM, ROM, a flash memory, a hard drive, or any device capable of storing machine readable instructions. Therefore, the electronic code may be a substantially continuous profile that mimics a continuous intensity profile or a collection of numerical digits corresponding to a set of discrete samples of the intensity profile.

Figure 4:
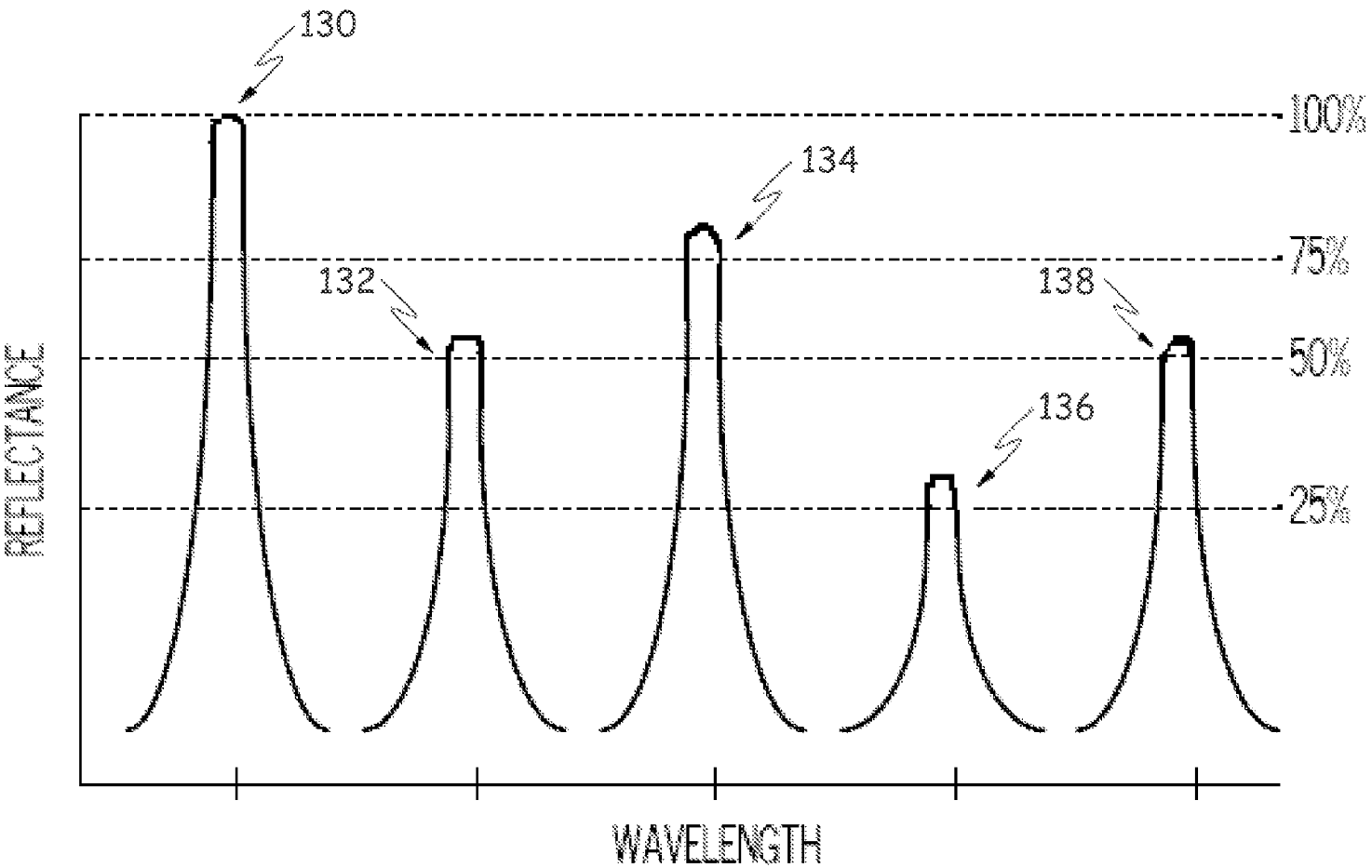
FIG. 4 graphically depicts an intensity profile according to one or more embodiments shown and described herein.

An intensity profile, such as a reflectance, a transmittance or an absorptance of the structure may be plotted as a function of the wavelength of light incident on the multilayer photonic structure 120. FIG. 4 shows an intensity profile, in this case a reflectance profile comprising peaks 130, 132, 134, 136, 138 at different wavelengths between about 900 nm to about 1600 nm. It is noted that, while five peaks are depicted in FIG. 4, the number of peaks in an intensity profile is unlimited. One practical consideration that may limit the number of permissible peaks within an intensity profile is the desired full width at half maximum (FWHM). The FWHM is the wavelength interval over which the magnitude of the intensity profile is equal to or greater than one half of the magnitude of the maximum intensity. The number of intensity profile peaks is inversely related to the FWHM, i.e. for greater FWHM the number of peaks will be decreased and for smaller FWHM the number of peaks will be increased. For example, in an embodiment with a FWHM of about 100 nm, as depicted in FIG. 4, the first reflectance peak 130 is centered at about 950 nm, the second reflectance peak 132 is centered at about 1100 nm, the third reflectance peak 134 is centered at about 1250 nm, the fourth reflectance peak 136 is centered at about 1400 nm, and the fifth reflectance peak 138 is centered at about 1550 nm. Furthermore, it is noted that the number of peaks may be increased by increasing the spectral bandwidth of the intensity profile, such as, for example, to between about 400 nm and about 2100 nm. In some embodiments, the intensity profile may contain a constant or no profile in the visible portion of the electromagnetic spectrum while varying the non-visible portions of the electromagnetic spectrum (e.g., infrared, and ultraviolet). Therefore, one unique intensity profile may vary from another unique intensity profile only in the non-visible portions of the electromagnetic spectrum.

In one embodiment, the electronic code is a collection of digits corresponding to a discrete sampling of the peaks of the intensity profile. For example, still referring to FIG. 4, the electronic code may be digitized to a five-digit alphanumeric code with a digit that corresponds to each of the peaks 130, 132, 134, 136, 138 of a reflectance profile. As used herein, the term "alphanumeric" means characters including letters, numbers, punctuation marks, machine readable codes or symbols, and the like.

In further embodiments, the alphanumeric digits may be based on a quantization of one of the peaks 130, 132, 134, 136, 138 of a reflectance profile. For example, four threshold levels of 25% reflectance, 50% reflectance, 75% reflectance, and 100% reflectance are depicted in FIG. 4. The reflectance profile peaks may be quantized through a threshold operation where a reflectance value is converted to a digit based on the largest threshold level the portion of the reflectance profile overcomes. Therefore, in one embodiment, the first reflectance peak 130 corresponds to 100%, the second reflectance peak 132 corresponds to 50%, the third reflectance peak 134 corresponds to 75%, the fourth reflectance peak 136 corresponds to 25%, and the fifth reflectance peak 138 corresponds to 50%. The quantized values may then be converted into an alphanumeric code such as "42312." While the present example describes converting the quantized values to numerals, it is noted that the quantized values may be digitized in any manner described herein to generate an electronic code. As described hereinabove, the reflectance profile may have any number of peaks. Furthermore, it is noted that the electronic code may comprise any number of digits sampled from any number of wavelengths. As a result, in some embodiments, the number of digits in the electronic code is independent of the number of peaks of the reflectance profile.

Referring again to FIG. 1, a method for identifying an article of manufacture may include a step 108 of loading paint in a container. Specifically, in one embodiment, a paint or a coating comprising a multilayer photonic structure 120 (FIG. 2) that produces a unique intensity profile is loaded into a container. The container may comprise material such as, for example, a metal, a plastic, or any other material that is non-reactive with the paint or coating. The term "container," as used herein, means a device capable of securing a volume for shipping, long-term storage, or short-term storage such as, for example, a canister, a drum, a tank, a supply-canister for a painting apparatus, and the like.

A method for identifying an article of manufacture may include a step 110 of applying coded indicia indicative of an electronic code to a container. The coded indicia are human readable or machine readable symbolic codes such as, for example, printed alphanumeric codes, bar codes, radio frequency identification, and the like. The coded indicia generally corresponds to the electronic code of the multilayer photonic structure 120 (FIG. 2) incorporated in the coating stored in the container. Therefore, in some embodiments, the coded indicia are also indicative of a unique intensity profile.

Figure 5:
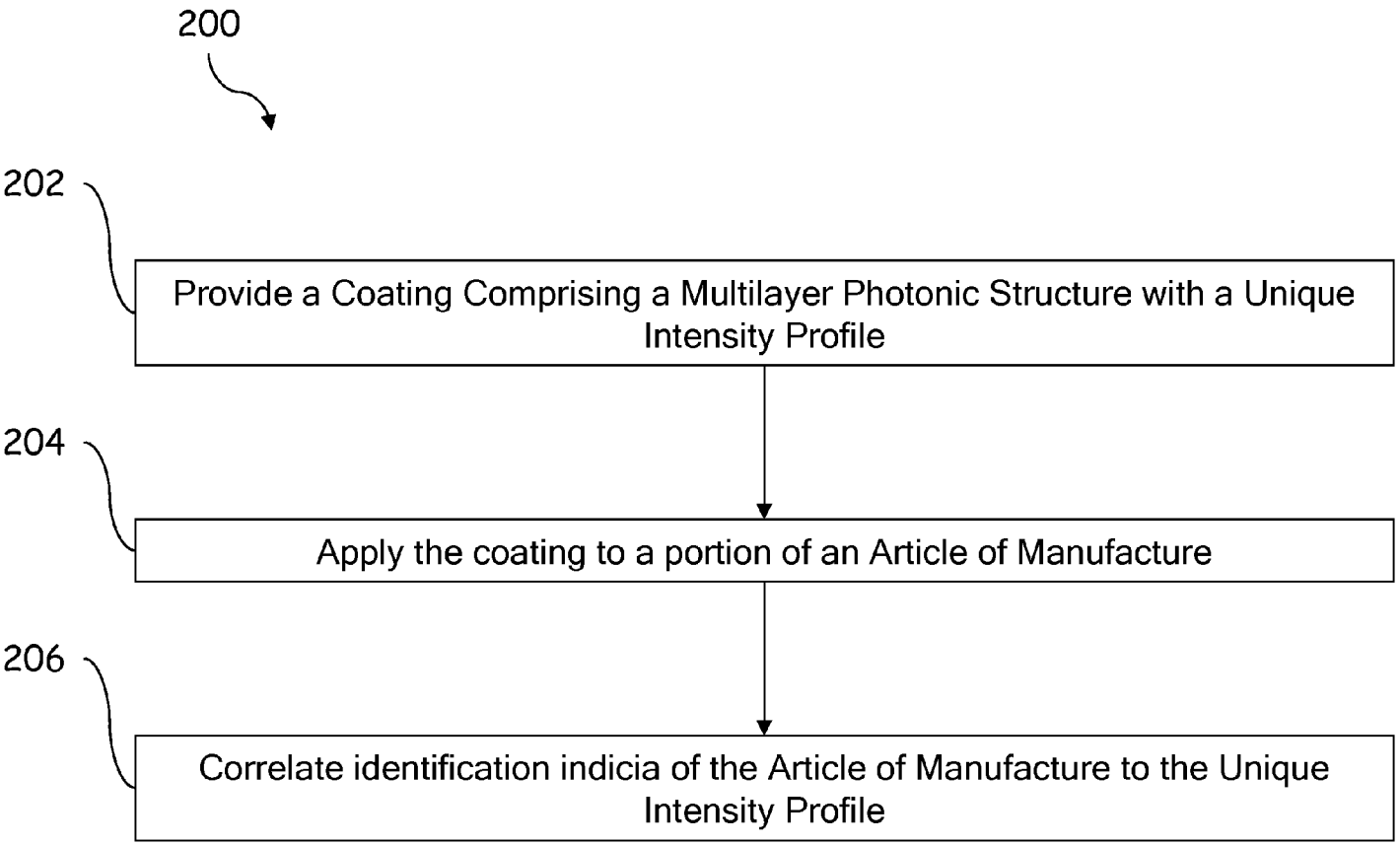
FIG. 5 is a flow diagram of a method for identifying an article of manufacture according to one or more embodiments shown and described herein.

Referring now to FIG. 5, a flow diagram 200 of the steps for identifying an article of manufacture is illustrated. While the steps listed in the flow diagram 200 are set out and described in a specific sequence, it should be understood that the order in which the steps are performed may be varied.

Referring collectively to FIGS. 3 and 5, a method for identifying an article of manufacture may include the step 202 of providing a coating 142 comprising a multilayer photonic structure 120 and the step 204 of applying the coating 142 to at least a portion of an article of manufacture, such as a vehicle 140. The coating 142, which may be a coating system, paint, clear coat or a single layer material, as described herein, can be applied to the article of manufacture, in its entirety or a portion thereof. For example, in one embodiment the coating 142 may be applied only to the frequently impacted areas of the vehicle 140. Specifically, in a vehicle 140, the frequently impacted areas are portions of the vehicle 140 that may be damaged by a collision such as, for example, a fender, a bumper, a door, a grille, a headlamp, a tail light, and the like.

Referring again to FIG. 5, a method for identifying a vehicle may include a step 206 of correlating identifying indicia of an article of manufacture to a unique intensity profile. In one embodiment, an electronic code may be generated to correspond to the intensity profile and the identifying indicia. The electronic code may contain digits which correspond directly to identifying indicia such as, for example, manufacturing information, model number, vehicle registration information, title information or vehicle identification number (VIN). When the identifying indicia is a VIN, vehicle identifying indicia such as a manufacturer, a vehicle category, a manufacturing division, a vehicle make, a vehicle model, a body style, or a sequential number may be made a portion of the electronic code. Specifically, the electronic code may comprise the same code or a portion of the code used in the VIN to identify the vehicle. Therefore, when the electronic code is also indicative of a unique intensity profile, the vehicle may be identified by the intensity profile.

In another embodiment, the electronic code may be stored in an electronic database. The electronic database comprises electronic data stored in an electronic memory that is accessible by a computing device. In a further embodiment, the electronic code may be stored in the electronic database and correlated with corresponding identifying indicia. Therefore, the electronic code may be indexed with the identifying indicia via the electronic database, i.e. the electronic code may be used to locate the identifying indicia in the electronic database, and/or the identifying indicia may be used to locate the electronic code in the database.

In an embodiment described herein, the electronic database is accessible via a portal. The portal provides access to and control of information within the electronic database. In one embodiment, the portal resides on an internet server and is available via the World Wide Web. Therefore, information organized by the electronic database may be accessed and controlled by connecting to the internet through an internet capable device, such as, for example, a personal computer or a mobile device.

Figure 6:
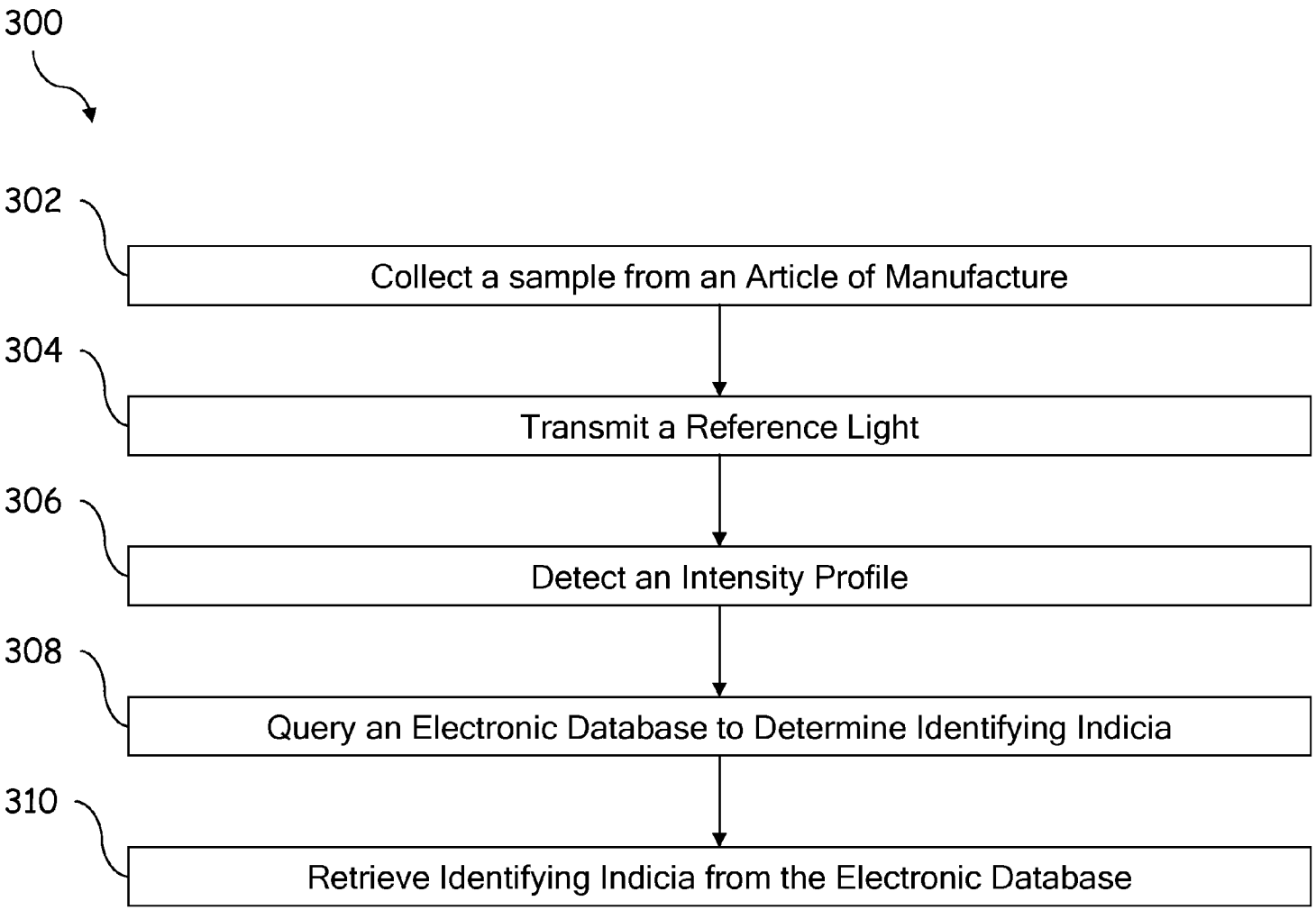
FIG. 6 is a flow diagram of a method for identifying an article of manufacture according to one or more embodiments shown and described herein.

Referring now to FIG. 6, a flow diagram 300 of the steps for identifying an article of manufacture is illustrated. While the steps listed in the flow diagram 300 are set out and described in a specific sequence, it should be understood that the order in which the steps are performed may be varied. A method for identifying an article of manufacture may include a step 302 of collecting a sample comprising a multilayer photonic structure 120 (FIG. 1) having a unique intensity profile from an article of manufacture.

For example, as depicted in FIG. 3, a sample 144 may be collected directly from an article of manufacture, such as the coating 142 of a vehicle 140. In another embodiment, a sample 144 may be collected from an object that has had a collision with the article of manufacture. Thus, if a vehicle 140 imparts a sample 144 of coating 142 on an object such as, for example, another vehicle, a guard rail, a building, a boulder or the like during a collision, the sample 144 can be retrieved.

Referring again to FIG. 6, a method for identifying an article of manufacture may include the step 304 of transmitting a reference light to the multilayer photonic structure 120 (FIG. 1) to produce an intensity profile, and the step 306 of detecting the intensity profile.

Figure 7:
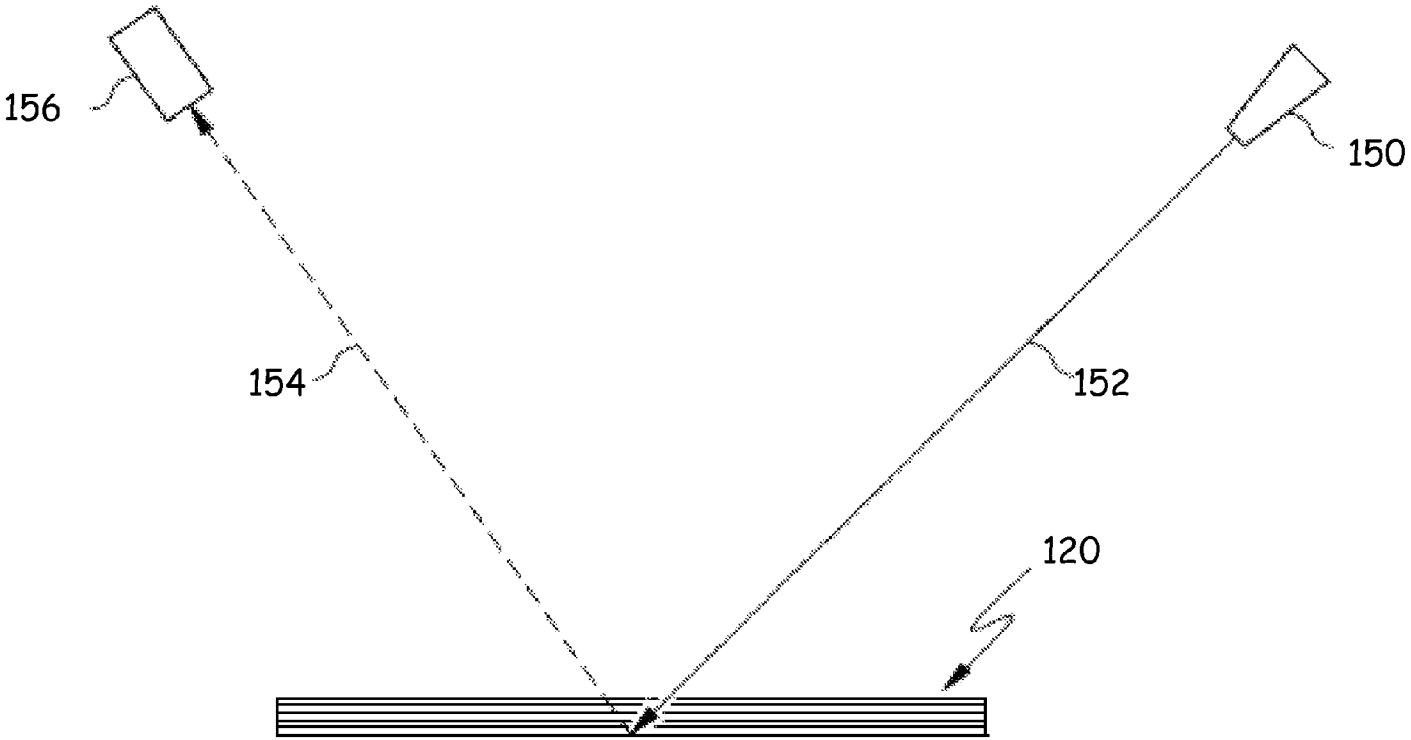
FIG. 7 schematically depicts a method for identifying an article of manufacture according to one or more embodiments shown and described herein.

In one embodiment, depicted schematically in FIG. 7, a broadband light source 150, e.g. a light source transmitting wavelengths across the full spectral width of the multilayer photonic structure 120, transmits a reference light 152 to the multilayer photonic structure 120. Although not depicted in FIG. 7, the multilayer photonic structure 120 may be in flake 128 (FIG. 3) form. The reference light 152 interacts with the multilayer photonic structure 120. The interaction between the reference light 152 and the multilayer photonic structure 120 produces an interaction light 154. The interaction light 154 is received by a photo-detector 156 which generates an intensity profile of the interaction light 154. While FIG. 7 schematically depicts measuring a reflectance, it is noted that a transmittance and absorptance may also be measured in an analogous manner. Furthermore, multiple intensity profiles may be measured by adding additional broadband light sources and/or photo-detectors. Once the intensity profile has been detected, an electronic code may be retrieved by digitizing and/or quantizing the intensity profile as described herein.

Referring again to FIG. 6, a method for identifying an article of manufacture may include the step 308 of querying an electronic database with the electronic code to determine identifying indicia of an article of manufacture. For example, the electronic database may be queried by manually searching a database stored in an electronic memory of a computer for an electronic code which corresponds to the identifying indicia and the intensity profile, i.e., viewing the database on a screen, or printing the database onto a tangible medium. The electronic database may also be queried by searching with an algorithm implemented by a computer program. For example, the identifying indicia may be automatically displayed on a screen upon entering the electronic code into the computer program.

A method for identifying an article of manufacture may also include the step 310 of retrieving identifying indicia of an article of manufacture from the electronic database to identify the article of manufacture. Specifically, once the electronic database has been queried any information correlated to the intensity profile may be retrieved, e.g., downloaded to an electronic memory, viewed on a display device, or printed on a tangible medium.

It should now be understood that the methods for identifying articles of manufacture described herein utilize the optical properties of multilayered photonic materials that produce a unique intensity profile. For example, a vehicle may be treated with a coating that comprises a multilayered photonic material that produces a unique intensity profile, i.e. the intensity profile is correlated with an electronic code which can be used to identify the vehicle. The electronic code may vary from an incomplete identifier such as paint color or a complete identifier such as the VIN of the vehicle. If the vehicle were to impart a portion of the coating onto another vehicle during a collision and then drive away, i.e. hit and run, the multilayer photonic structure could be analyzed to identify the missing vehicle. Specifically, the coating may be sampled for optical analysis that reveals the intensity profile. The intensity profile may then be utilized alone or in combination with other information, to identify the missing vehicle.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. More-over, although various aspects of the claimed subject matter have been described herein, such aspects need not be utilized in combination. It is therefore intended that the appended claims cover all such changes and modifications that are within the scope of the claimed subject matter.

What is claimed is:

1. A method for identifying an article of manufacture comprising:

producing a plurality of multilayer photonic structures, wherein each of the multilayer photonic structures comprises alternating layers of high index material and low index material such that each of the multilayer photonic structures has one more layer of the high index material than the low index material, and wherein each of the plurality of multilayer photonic structures has a unique intensity profile in a non-visible portion of an electromagnetic spectrum, and a substantially common intensity profile in a visible portion of the electromagnetic spectrum;

incorporating one of the plurality of multilayer photonic structures that produces the unique intensity profile into a coating; and generating an electronic code corresponding to the unique intensity profile of one of the plurality of multilayer photonic structures.

2. The method for identifying an article of manufacture of claim 1 wherein the unique intensity profile is a reflectance profile, a transmittance profile, or a combination thereof.

3. The method for identifying an article of manufacture of claim 1 further comprising:

loading the coating in a container; and applying a coded indicia indicative of the electronic code to the container.

4. The method for identifying an article of manufacture of claim 1, wherein the unique intensity profile comprises a plurality of peaks each having a full width at half maximum value of about 100 nm or less.

5. A method for identifying an article of manufacture comprising:

providing a coating comprising a multilayer photonic structure, wherein the multilayer photonic structure comprises alternating layers of high index material and low index material such that the multilayer photonic structure has one more layer of the high index material than the low index material, and wherein the multilayer photonic structure produces a unique intensity profile in a non-visible portion of an electromagnetic spectrum, and a substantially common intensity profile in a visible portion of the electromagnetic spectrum;

applying the coating to at least a portion of an article of manufacture; and correlating an identifying indicia of the article of manufacture to the unique intensity profile.

6. The method for identifying an article of manufacture of claim 5 wherein the unique intensity profile is a reflectance profile, a transmittance profile, or a combination thereof.

7. The method for identifying an article of manufacture of claim 5 further comprising:

generating an electronic code corresponding to the unique intensity profile; and correlating the identifying indicia of the article of manufacture to the electronic code.

8. The method for identifying an article of manufacture of claim 7 further comprising storing the electronic code in an electronic database such that the unique intensity profile is indexed according to the electronic code.

9. The method for identifying an article of manufacture of claim 8 wherein the electronic code comprises a digit and a quantized peak of the unique intensity profile corresponds to the digit.

10. The method for identifying an article of manufacture of claim 5 wherein the article of manufacture is a vehicle.

11. The method for identifying an article of manufacture of claim 10 wherein the identifying indicia is at least one of a manufacturer, a vehicle category, a manufacturing division, a vehicle make, a body style, a vehicle model, and a sequential number.

12. The method for identifying an article of manufacture of claim 11 wherein the coating is applied to a frequently impacted area of the vehicle.

13. The method for identifying an article of manufacture of claim 5 wherein the coating is a paint, a clear coat, or a sheet.

14. A method for identifying an article of manufacture comprising:

collecting a sample from an article of manufacture, wherein the sample comprises a multilayer photonic structure, wherein the multilayer photonic structure comprises alternating layers of high index material and low index material such that the multilayer photonic structure has one more layer of the high index material than the low index material, and wherein the multilayer photonic structure has a unique intensity profile in a non-visible portion of an electromagnetic spectrum, and a substantially common intensity profile in a visible portion of the electromagnetic spectrum;

transmitting a reference light to the multilayer photonic structure to produce the unique intensity profile;

detecting the unique intensity profile;

querying an electronic database to determine identifying indicia of the article of manufacture;

retrieving the identifying indicia of the article of manufacture from the electronic database to identify the article of manufacture.

15. The method for identifying an article of manufacture of claim 14 wherein the unique intensity profile is a reflectance profile, a transmittance profile, or a combination thereof.

16. The method for identifying an article of manufacture of claim 14 further comprising retrieving an electronic code indicative of the unique intensity profile, wherein the electronic database is queried with the electronic code.

17. The method for identifying an article of manufacture of claim 14 wherein the sample is removed from an object after a collision with the article of manufacture.

18. The method for identifying an article of manufacture of claim 14 further comprising quantizing the unique intensity profile.

19. The method for identifying an article of manufacture of claim 14 wherein the identifying indicia is a vehicle identification number.

20. The method for identifying an article of manufacture of claim 14 wherein the identifying indicia is at least one of a manufacturer, a vehicle category, a manufacturing division, a vehicle make, a vehicle model, a body style, and a sequential number.

* * * * *

UNITED STATES PATENT AND TRADEMARK OFFICE

CERTIFICATE OF CORRECTION

PATENT NO. : 8,257,784 B2
APPLICATION NO. : 12/853801
DATED : August 10, 2010
INVENTOR(S) : Benjamin Alan Grayson et al.

It is certified that error appears in the above-identified patent and that said Letters Patent is hereby corrected as shown below:

Title page, item [75] Inventors, change "Debasish Benerjee" to "Debasish Banerjee"

Signed and Sealed this
Eighteenth Day of December, 2012

David J. Kappos

David J. Kappos
*Director of the United States Patent and Trademark Office*